US005263881A

United States Patent [19]

Henrici et al.

[11] Patent Number: 5,263,881

[45] Date of Patent: Nov. 23, 1993

[54] SOCKET FOR HALOGEN BULB

[75] Inventors: Dieter Henrici; Alfred Bothe, both of Arnsberg, Fed. Rep. of Germany

[73] Assignee: Brokelmann, Jaeger & Busse GmbH & Co., Arnsberg, Fed. Rep. of Germany

[21] Appl. No.: 856,017

[22] Filed: Mar. 23, 1992

[30] Foreign Application Priority Data

Mar. 23, 1991 [DE] Fed. Rep. of Germany ..... 4109678

[51] Int. Cl.[5] ..... H01R 13/502

[52] U.S. Cl. ..... 439/686; 439/683

[58] Field of Search ..... 439/683, 686, 701, 695, 439/702, 707, 419, 684, 699

[56] References Cited

U.S. PATENT DOCUMENTS 4,820,204 4/1989 Batty ..... 439/695

FOREIGN PATENT DOCUMENTS 0496893 11/1950 Belgium ..... 439/419
0198423 10/1986 European Pat. Off. .
8806272 8/1988 Fed. Rep. of Germany .
9103617 8/1991 Fed. Rep. of Germany .
2560427 8/1985 France .
0610157 10/1960 Italy ..... 439/419
0336369 10/1930 United Kingdom ..... 439/419
0341265 1/1931 United Kingdom ..... 439/419

*Primary Examiner*—Larry I. Schwartz
*Assistant Examiner*—Hien D. Vu
*Attorney, Agent, or Firm*—Herbert Dubno; Andrew Wilford

[57] ABSTRACT

A light-bulb socket has two main parts, namely a socket cup having a base provided with a pair of upwardly exposed contacts and formed with a plurality of throughgoing mounting holes and a base disk fitted tightly to the base of the cup and formed with passages through which conductors connected to the contacts can pass. The base disk is unitarily formed with a pair of mounting sleeves projecting upward through the mounting holes of the cup. The sleeves are formed as short tubes that are a tight force fit in the mounting holes and are each formed with a deformable rib to enhance the tight fit.

10 Claims, 6 Drawing Sheets

SOCKET FOR HALOGEN BULB

FIELD OF THE INVENTION

The present invention relates to a light-bulb socket. More particularly this invention concerns a socket for a halogen lamp bulb.

BACKGROUND OF THE INVENTION

A typical halogen-lamp bulb has a glass envelope from one end of which projects two connection pins. This one end is inserted into an insulating and heat-resistant socket equipped with connectors that fit with the connection pins to supply electric current to them. Leads from the connector extend to the switch and power supply.

Such a socket is typically constituted as an outer cup that is made of porcelain or a heat-resistant plastic and that fits around the pin end of the bulb, and whose base is formed with two apertures through which the pins pass. A connector-holding disk is fitted to the base of the disk to hold in place the pin connectors. Sleeve rivets join the disk to the cup to hold the connectors in place and mounting screws or the like can be fitted through the sleeve rivets to mount the socket to its support.

Thus this socket, which is a mass-produced item, is relatively complex. It is fairly costly to manufacture and not easy to assemble.

OBJECTS OF THE INVENTION

It is therefore an object of the present invention to provide an improved light-bulb socket.

Another object is the provision of such an improved light-bulb socket which overcomes the above-given disadvantages, that is which is relatively inexpensive to manufacture and easy to assemble.

SUMMARY OF THE INVENTION

A light-bulb socket according to the invention has two main parts, namely a socket cup having a base provided with a pair of upwardly exposed contacts and formed with a plurality of throughgoing mounting holes and a base disk fitted tightly to the base of the cup and formed with passages through which conductors connected to the contacts can pass. The base disk is unitarily formed with a pair of mounting sleeves projecting upward through the mounting holes of the cup.

Thus this system completely does away with the rivets, cutting the number of parts for the socket substantially. At the same time it in now way increases the cost of the normally molded base which is unitarily formed with the mounting sleeves.

The sleeves according to this invention are formed as short tubes. They are a tight force fit in the mounting holes and are each formed with a deformable rib to enhance the tight fit.

To further simplify assembly and mounting each sleeve is provided internally with a laterally elastically deflectable mounting pin having a head projecting past a respective end of the sleeve. Each pin, which is unitary with the disk, can project upward or downward past the upper or lower end of the respective sleeve for top or bottom mounting of the socket.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
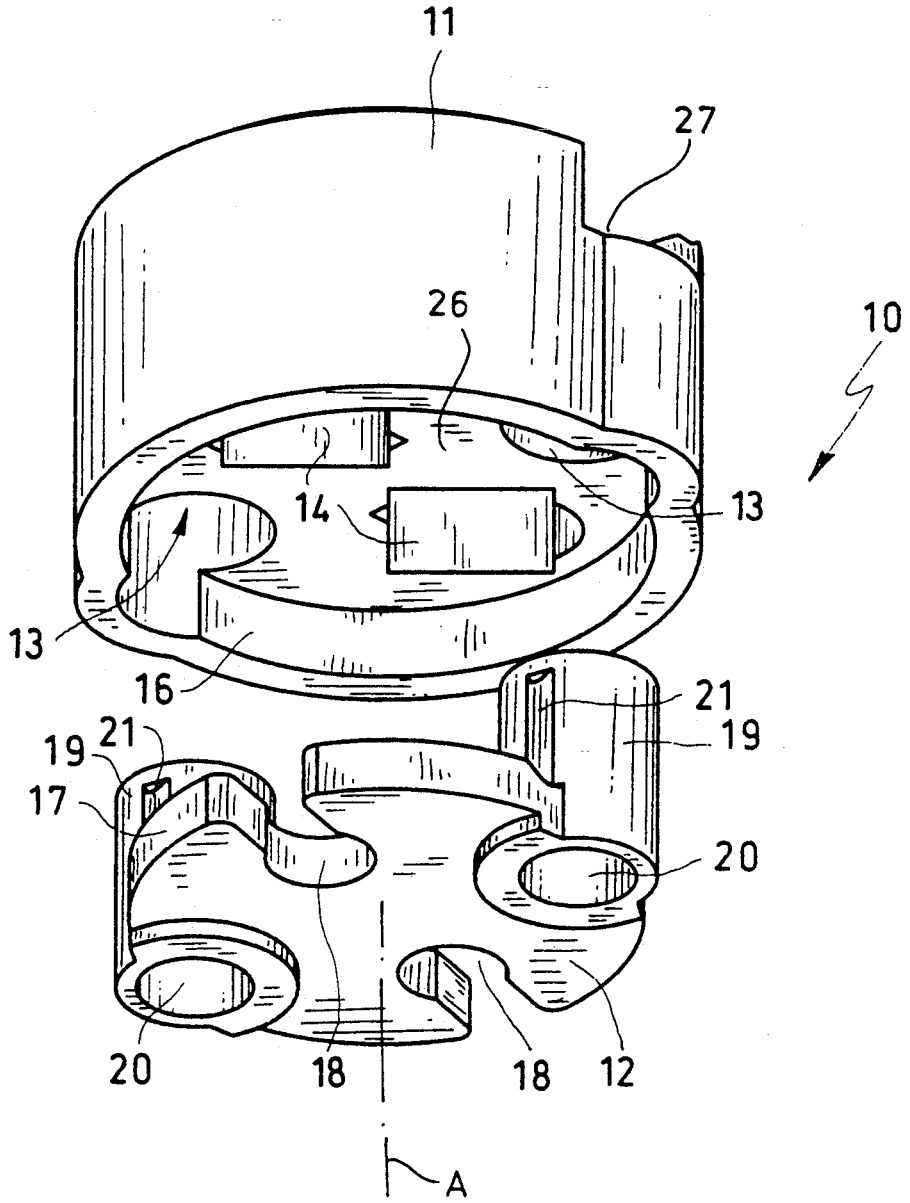
FIG. 1 is an exploded perspective view of the socket according to the invention.
Figure 2:
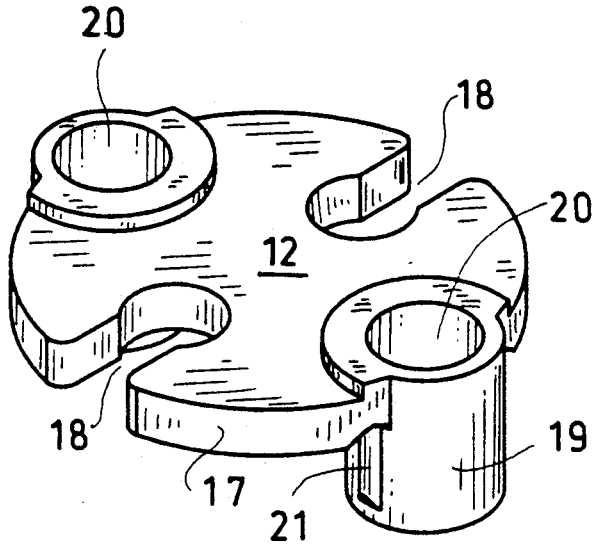
FIGS. 2 and 3 are top and bottom perspective views of the base disk of the FIG. 1 socket.
Figure 3:
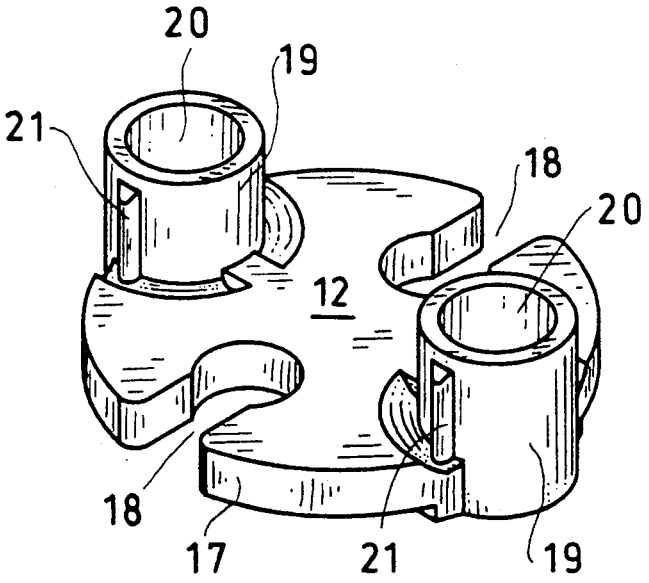
Figure 4:
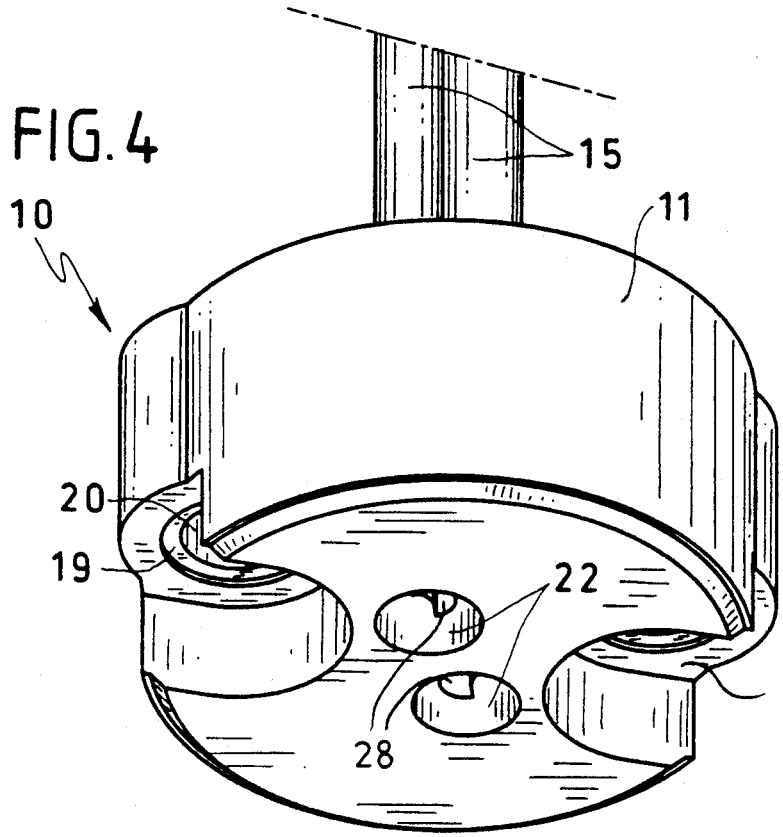
FIGS. 4 and 5 are top and bottom perspective views of the assembled socket
Figure 5:
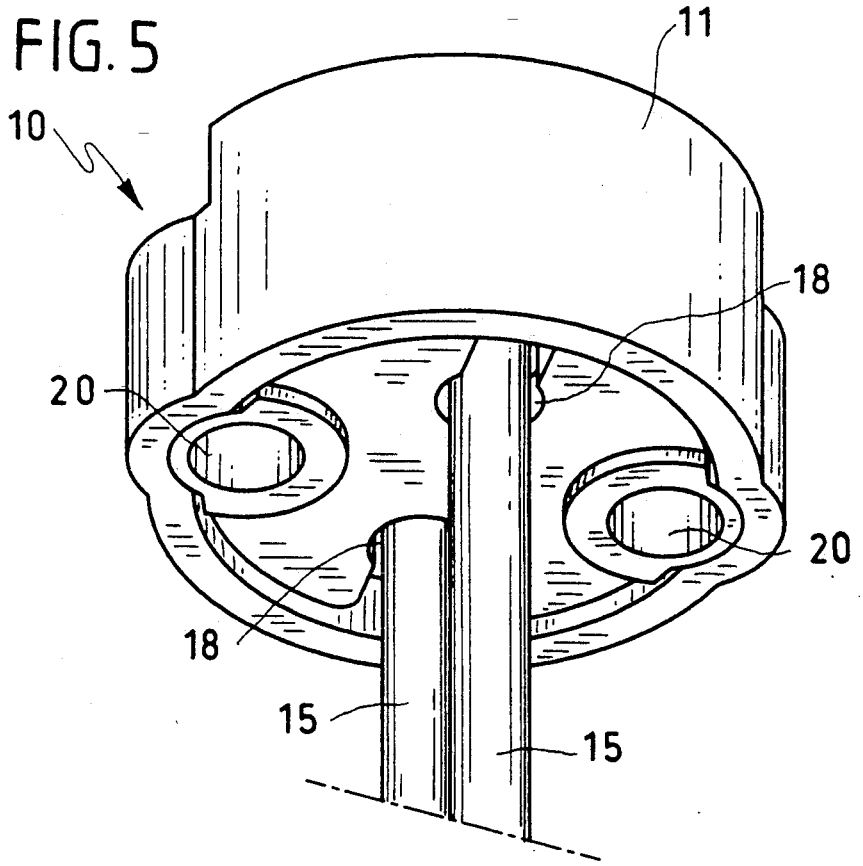

As seen in FIGS. 1 through 5, a halogen-bulb socket 10 according to this invention basically comprises a main housing cup 11 centered on an axis A and made of porcelain or a heat-resistant synthetic resin, and a base part 12. The cup 11 has a cylindrical side wall closed by a thick floor wall 26 formed with two throughgoing holes or passages 13 of cylindrical shape and two downwardly open square pockets 14 joined to upwardly open cylindrical holes 22 (FIG. 4) through which the contact pins of the unillustrated bulb project. The upper surface of the wall 26 is formed with a pair of recesses 27 at the holes 13. The cup 11 has a downwardly projecting annular rim 16 of a height equal to the thickness of disk 17 of the base part 12. FIG. 4 shows how pin contacts 28 are held in the pockets 22 and are connected to conductors 15 for connection to the pins of the unillustrated bulb.

The disk 17 itself is complementary to the generally cylindrical recess formed by the rim 16 of the cup 11 and is formed with two diametrically opposite cutouts 18 that in the assembled socket are aligned with the square pockets 14. These cutouts 18 are smaller than the pockets 14 so that the pin contacts 28 are captured in the pockets when the socket 10 is assembled.

In accordance with the invention the disk 17 is formed unitarily of a heat-resistant synthetic resin with two cylindrical sleeves 19 that are diametrically opposite each other and dimensioned to fit snugly in the cylindrical holes 13 of the cup 11. These sleeves 19 each form a respective cylindrical passage or hole 20 extending parallel to the axis A and are each formed with at least one radially outwardly projecting rib 21. Thus the disk 17 can be pressed up against the cup floor wall 26 to force the sleeves 19 into the holes 13 and deform the ribs 21, thereby press-fitting the two parts together. The holes 20 can accommodate mounting screws for the finished assembly. Thus the socket 10 according to this invention has only two main parts, as the sleeves 19 eliminate the need for separate rivets.

Figure 6:
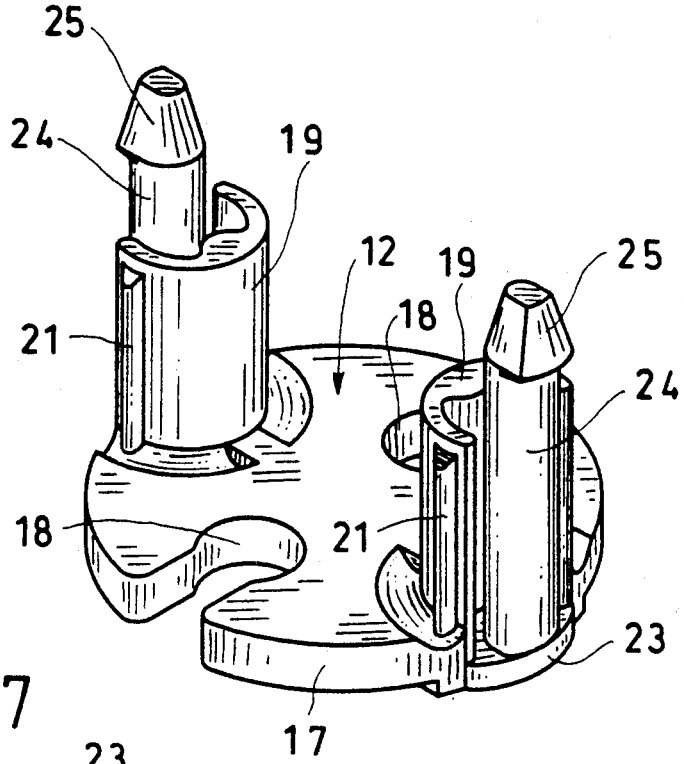
FIGS. 6 and 7 are views like FIGS. 2 and 3 of a variant on the bottom disk.
Figure 7:
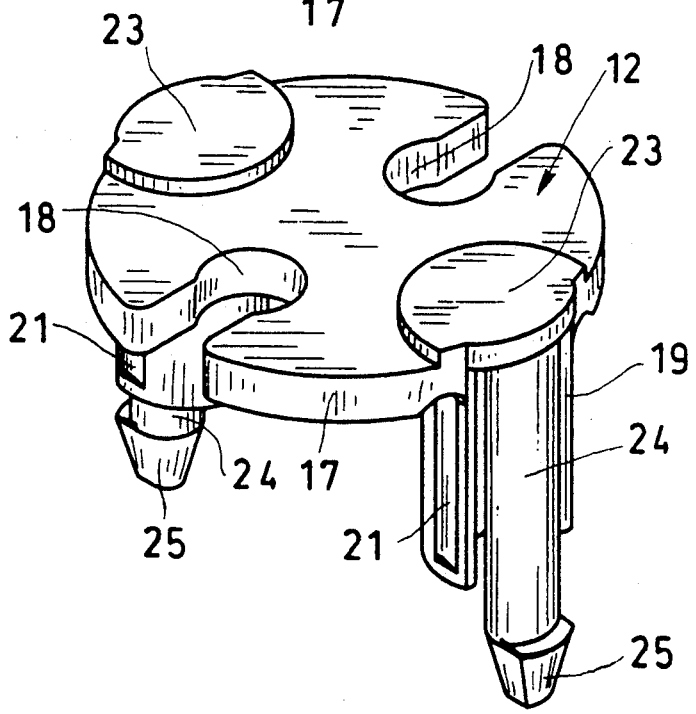
Figure 8:
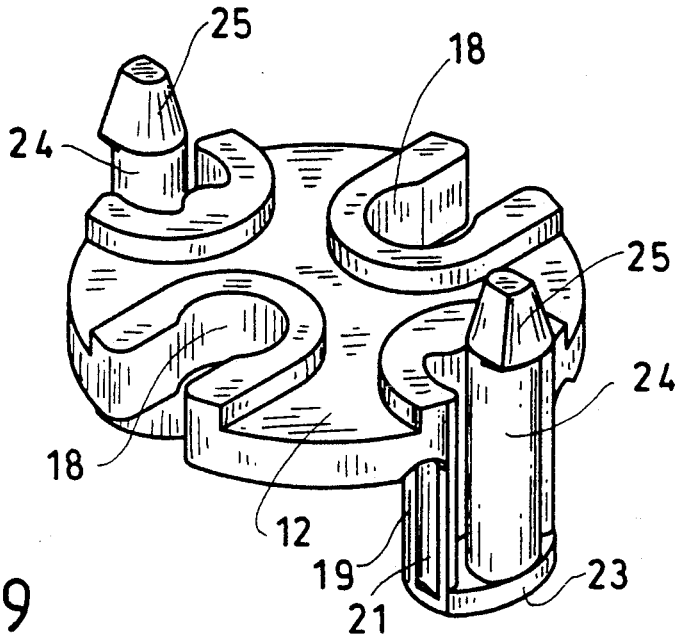
FIGS. 8 and 9 are views like FIGS. 2 and 3 of another variant on the bottom disk.

FIGS. 6 through 8 show how the sleeves 19 are formed with a longitudinal slot making them outwardly open and of U-section. Each sleeve 19 is provided with a respective pin 24 which has an outwardly barbed outer pin head 25. In FIGS. 6, 7, 10*a*, and 10*b* the pins 24 extend from disks 23 that close the lower end of the respective passages 20 so that the pin heads 25 extend a distance d beyond the upper surface of the cup 11. Thus an unillustrated mounting lug seated to the recess 27 can be snap-fitted under the respective pin head 25 to top mount the socket.

Figure 9:
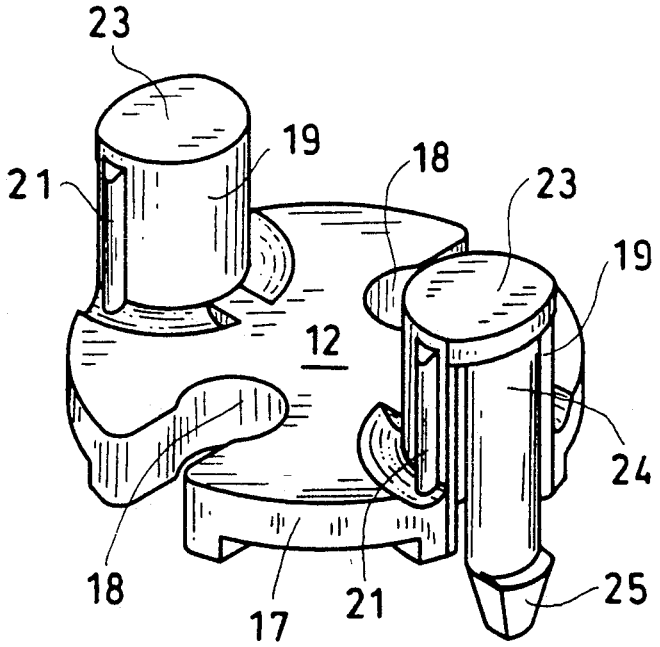
Figures 10A, 10B:
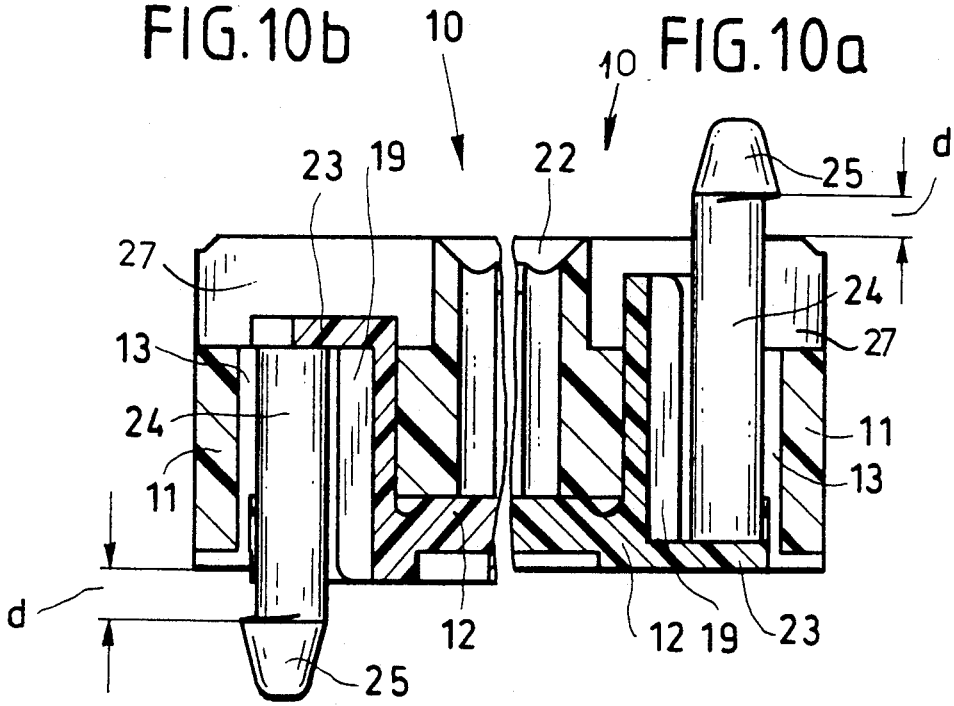
FIGS. 10*a* and 10*b* are axial sections through sockets embodying the disks of FIGS. 6 and 8, respectively.

In FIGS. 8 and 9 the pin disk 23 is provided at the top of the longitudinally slit sleeve 19 and the pin head 25 projects the distance d beyond the bottom of the cup 11 for bottom mounting of the socket 10. In both cases the pins 24 allow the socket to be mounted in place without the use of separate parts, and makes it possible to produce the socket at very low cost.

We claim:

1. A light-bulb socket comprising:

a socket cup having a base provided with a pair of upwardly exposed contacts and formed with a plurality of through-going mounting holes; and a base disk fitted tightly to the base of the cup and formed with passages through which conductors connected to the contacts can pass, the base disk being unitarily formed with a pair of mounting sleeves projecting upwardly through the mounting holes of the cup and each provided with an integral retaining formation lockingly engaged with the socket cup and retaining the disk and cup together.

2. The light-bulb socket defined in claim 1 wherein the sleeves are formed as short tubes.

3. The light-bulb socket defined in claim 2 wherein the sleeves are a tight force fit in the mounting holes.

4. The light-bulb socket defined in claim 1 wherein each sleeve is provided internally with a mounting pin constituting the respective retaining formation and having a head projecting past a respective end of the sleeve.

5. The light-bulb socket defined in claim 1 wherein the cup is formed with a downwardly projecting rim within which the disk is fitted.

6. The light-bulb socket defined in claim 1 wherein each sleeve is provided internally with a mounting pin formed unitarily with the disk and projecting past a respective end of the respective sleeve.

7. The light-bulb socket defined in claim 6 wherein the sleeves project upward from the disk and the pin heads project upward from the respective sleeves.

8. The light-bulb socket defined in claim 6 wherein the sleeves project upward from the disk and the pin heads project downward from the respective sleeves.

9. The light-bulb socket defined in claim 1 wherein each formation is at least one deformable longitudinal rib deformed on engagement of the respective sleeve in the respective mounting hole.

10. A light-bulb socket comprising:

a socket cup unitarily formed with a flat and disk like base formed with a pair of downwardly and upwardly open contact pockets and with a pair of throughgoing mounting holes, and a cylindrical side wall projecting downward as a rim past a lower surface of the base;

pin contacts held in the pockets of the base;

a base disk fitted within the rim to the base of the cup and formed with passages aligned with the contact pockets, the base disk being unitarily formed with a pair of mounting sleeves projecting upwardly through the mounting holes of the cup and each formed with an integral retaining formation lockingly engaged with the socket cup and retaining the disk and cup together; and respective wires projecting through the passages into the pockets and there connected to the contacts.

* * * * *